US008191291B2

(12) United States Patent
Vanderpoorten et al.

(10) Patent No.: US 8,191,291 B2
(45) Date of Patent: Jun. 5, 2012

(54) WEAR MEMBER FOR EXCAVATING EQUIPMENT

(75) Inventors: Gerald Vanderpoorten, Newton, MS (US); Bodie Delane Cooper, Brandon, MS (US)

(73) Assignee: Esco Corporation, Portland, OR (US)

( * ) Notice: Subject to any disclaimer, the term of this patent is extended or adjusted under 35 U.S.C. 154(b) by 73 days.

(21) Appl. No.: 12/499,542

(22) Filed: Jul. 8, 2009

(65) Prior Publication Data

US 2010/0170121 A1 Jul. 8, 2010

Related U.S. Application Data

(60) Provisional application No. 61/079,308, filed on Jul. 9, 2008.

(51) Int. Cl.
*A01B 13/08* (2006.01)

(52) U.S. Cl. ..... 37/453

(58) Field of Classification Search ..... 37/446–460; 172/699, 701.1, 701.3, 664, 719, 749, 734–739, 172/750–753; 299/106, 107; 403/361, 383
See application file for complete search history.

(56) References Cited

U.S. PATENT DOCUMENTS

| | | | | | |
|---|---|---|---|---|---|
| 1,237,610 | A | * | 8/1917 | Brenno | 172/369 |
| 1,333,394 | A | * | 3/1920 | Ekman | 37/453 |
| 1,835,701 | A | * | 12/1931 | Edmunds | 37/460 |
| 1,959,847 | A | * | 5/1934 | Van Buskirk | 37/450 |
| 2,005,016 | A | * | 6/1935 | Van Buskirk | 37/452 |
| 2,247,202 | A | * | 6/1941 | Ratkowski | 37/452 |
| 2,360,315 | A | * | 10/1944 | Campbell et al. | 37/454 |
| 2,608,111 | A | * | 8/1952 | Ratkowski | 76/115 |
| 2,702,698 | A | * | 2/1955 | Snyder et al. | 299/101 |
| 2,904,908 | A | * | 9/1959 | Ratkowski | 37/458 |
| 3,286,379 | A | * | 11/1966 | Benetti | 37/452 |
| 3,309,801 | A | * | 3/1967 | Ratkowski | 37/453 |
| D207,451 | S | * | 4/1967 | Wilson | D15/29 |
| 3,312,002 | A | * | 4/1967 | Benetti | 37/452 |
| 3,736,676 | A | * | 6/1973 | Sturgeon | 37/452 |
| 3,755,933 | A | * | 9/1973 | Lowrey | 37/454 |
| 3,888,028 | A | * | 6/1975 | White | 37/452 |
| 3,947,982 | A | * | 4/1976 | Mantovani | 37/450 |

(Continued)

FOREIGN PATENT DOCUMENTS

EP 232468 A1 * 8/1987

(Continued)

OTHER PUBLICATIONS

ESCO Corporation, ESCO Super Conical Tooth Systems; Jul. 1980; (2 pgs.) Catalog 117, Section 7; Portland, OR.

*Primary Examiner* — Robert Pezzuto
(74) *Attorney, Agent, or Firm* — Steven P. Schad

(57) ABSTRACT

A wear member for attachment along the digging edge of excavating equipment that includes ridges formed along its front working end. As the front end wears away, the tips of the ridges along the front of the wear member project forward to define a serrated penetrating edge. A serrated front edge is able to more easily cut into and through the ground. The ridges may be arranged in a generally axial direction along the front working end to present a reduced surface area to contact the ground for easier penetration. The ridges provide the front working end with sufficient rigidity and strength without unduly enlarging the surface area of the penetrating edge that initiates contact with the ground.

16 Claims, 6 Drawing Sheets

U.S. PATENT DOCUMENTS

| | | | | | |
|---|---|---|---|---|---|
| 3,959,901 | A | * | 6/1976 | Klett | 37/452 |
| 4,028,823 | A | * | 6/1977 | Edwards et al. | 37/452 |
| 4,117,611 | A | * | 10/1978 | Hemphill | 37/452 |
| 4,227,744 | A | * | 10/1980 | Livesay | 299/100 |
| 4,711,503 | A | * | 12/1987 | Berchem et al. | 299/105 |
| 4,835,888 | A | * | 6/1989 | Hemphill | 37/457 |
| D329,243 | S | * | 9/1992 | Robinson | D15/29 |
| 5,188,680 | A | * | 2/1993 | Hahn et al. | 148/593 |
| 5,325,615 | A | * | 7/1994 | Hutchins et al. | 37/455 |
| 5,375,350 | A | * | 12/1994 | Maybon | 37/460 |
| 5,778,570 | A | * | 7/1998 | Eichelberger | 37/450 |
| 5,966,848 | A | * | 10/1999 | Monteiro et al. | 37/452 |
| D463,460 | S | * | 9/2002 | Siebeck et al. | D15/29 |
| 6,490,816 | B2 | * | 12/2002 | Ketting | 37/454 |
| 7,114,272 | B2 | * | 10/2006 | Clendenning et al. | 37/452 |
| 2002/0166268 | A1 | * | 11/2002 | Ruvang | 37/452 |

FOREIGN PATENT DOCUMENTS

| | | | | |
|---|---|---|---|---|
| JP | 10183698 | A | * | 7/1998 |

* cited by examiner

WEAR MEMBER FOR EXCAVATING EQUIPMENT

FIELD OF THE INVENTION

The present invention pertains to a wear member adapted to attach to the digging edge of excavating equipment.

BACKGROUND OF THE INVENTION

Wear parts are commonly attached along the lip of an excavating bucket or the digging edge of other excavating equipment to protect the equipment from wear and enhance the digging operation. The wear parts may be excavating teeth, shrouds, or other wear members. These assemblies typically include a base, a wear member, and a lock. The base is fixed to the digging edge by welding, a removable lock or other means, and the wear member fits over the base. The assembled base and wear member cooperatively define an opening into which the lock is received to releasably hold the wear member to the base.

The wear members include rear mounting ends to be secured to the excavating equipment and front working ends to engage and penetrate the ground. The rear mounting end ordinarily includes a socket for receiving a nose projecting from the digging edge of the equipment. The front working end includes top and bottom surfaces that converge toward a front penetrating edge. These wear members are typically subjected to harsh conditions. As a result, they wear out over a period of time and need to be replaced.

SUMMARY OF THE INVENTION

The present invention pertains to a wear member for attachment along the digging edge of excavating equipment, wherein the wear member has an enhanced ability to penetrate the ground.

In accordance with one aspect of the invention, the wear member includes ridges formed along its front working end. As the front end wears away, the tips of the ridges along the front of the wear member project forward to define a serrated penetrating edge. A serrated front edge is able to more easily cut into and through the ground.

In a further aspect of the invention, the ridges are arranged in a generally axial direction along the front working end to present a reduced surface area to contact the ground for easier penetration. More specifically, the ridges provide the front working end with sufficient rigidity and strength without unduly enlarging the surface area of the penetrating edge that initiates contact with the ground.

In a further aspect of the invention, the front working end of the wear member has an enlarged width (i.e., it is wider than the mounting portion that receives the nose) to break up a wider expanse of the ground in advance of the lip. The increased ground-engaging surface area caused by the enlarged front end is offset by the overall enhanced ability of the wear member to penetrate the ground. Hence, the digging efficiency is not reduced as compared to customary wear members.

DETAILED DESCRIPTION OF THE PREFERRED EMBODIMENTS

Figure 1:
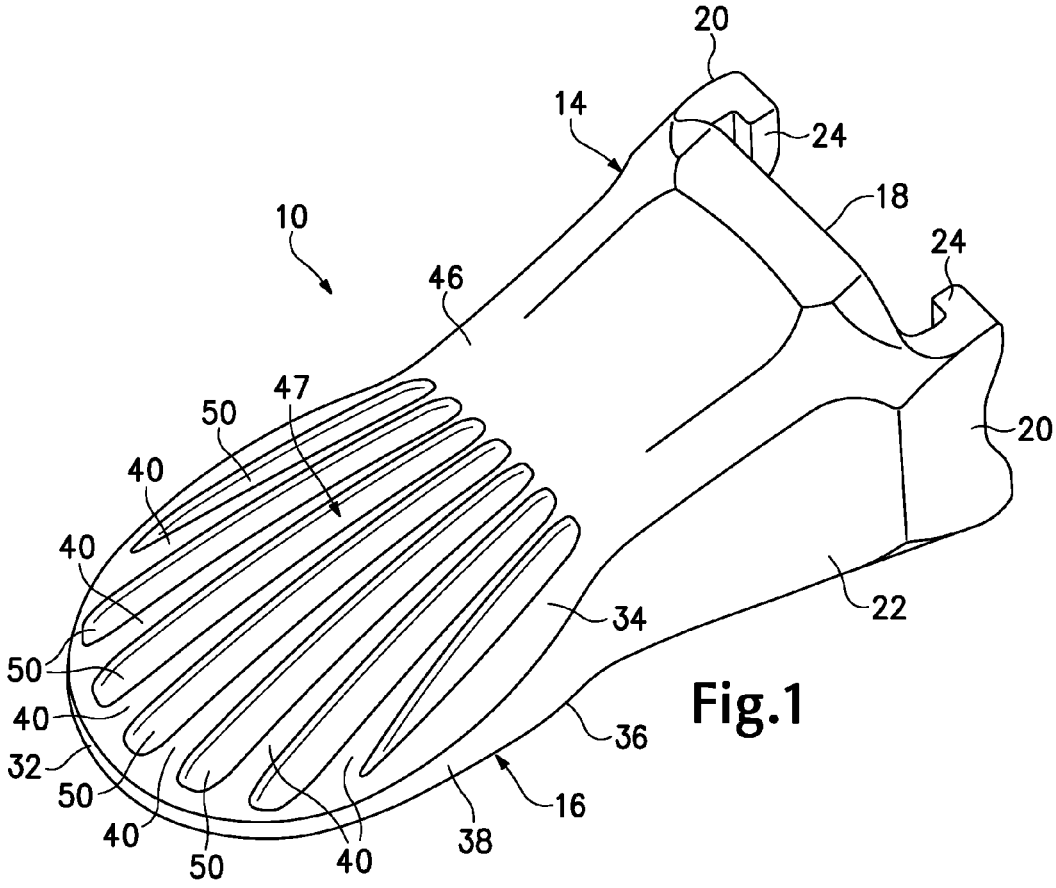
FIG. 1 is a perspective view of a wear member in accordance with the present invention.
Figure 2:
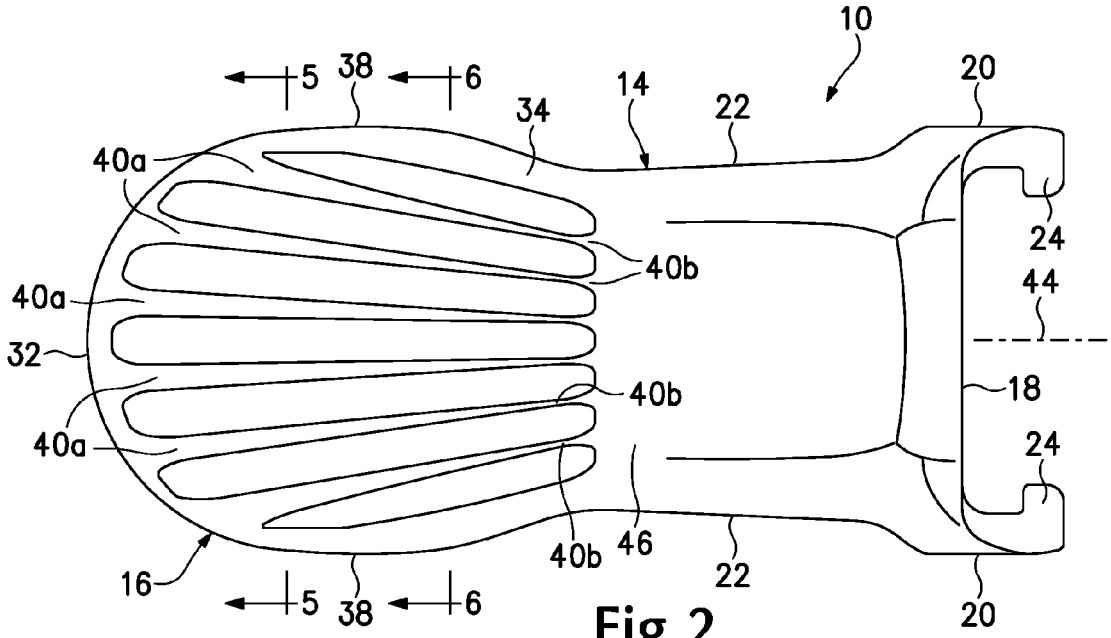
FIG. 2 is a top view of the wear member.
Figure 3:
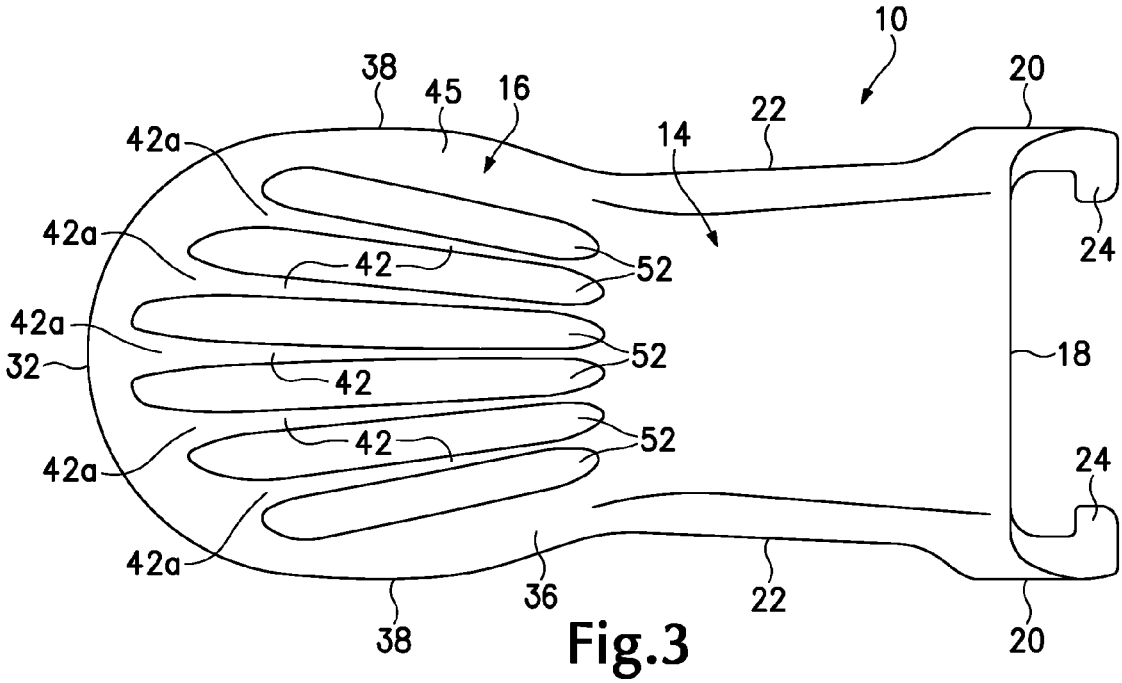
FIG. 3 is a bottom view of the wear member.

The present invention pertains to a wear member 10 (FIGS. 1-10) that attaches to the digging edge 12 of excavating equipment. The wear member is particularly suited to be a point for a tooth on an excavating bucket (FIG. 10), but could be in the form of other kinds of wear parts (e.g., shrouds) or attached to other excavating equipment (e.g., dredge cutterheads). In this application, relative terms such as forward, rearward, top, bottom, up or down are used for convenience of explanation with reference to FIG. 1; other orientations are possible.

The wear member or point 10 has a rear mounting end 14 that attaches to a lip 12 of a bucket, and a front working end 16 that engages and penetrates the ground or other material to be gathered (FIGS. 1-4 and 10). In the illustrated example, mounting end 14 is provided with a socket or cavity that opens in rear wall 18 to receive a nose (not shown). The nose can be part of an adapter that attaches to the bucket or it can be formed as an integral part of the bucket lip. Ears 20 extend from sidewalls 22 of point 10 to support vertically spaced apart lugs 24, such as disclosed in U.S. Pat. No. 5,469,648 (incorporated herein by reference). A lock (not shown) is fit between lugs 24 and a shoulder on the nose to releasably hold the point to the nose. As another alternative (FIG. 11), point 10*a* can be provided with a socket 25 having corner stabilized surfaces (such as taught in U.S. Pat. No. 5,709,043, incorporated herein by reference) and one or more ears 20*a* to receive a lock (such as taught in U.S. Pat. No. 6,993,861, incorporated herein by reference). While these mounting ends function well, they are only examples of mounting ends that could be used; virtually any mounting configuration used to secure wear members to the digging edges of excavating equipment could be used in conjunction with the present invention including those based on projections instead of sockets.

Figure 10:
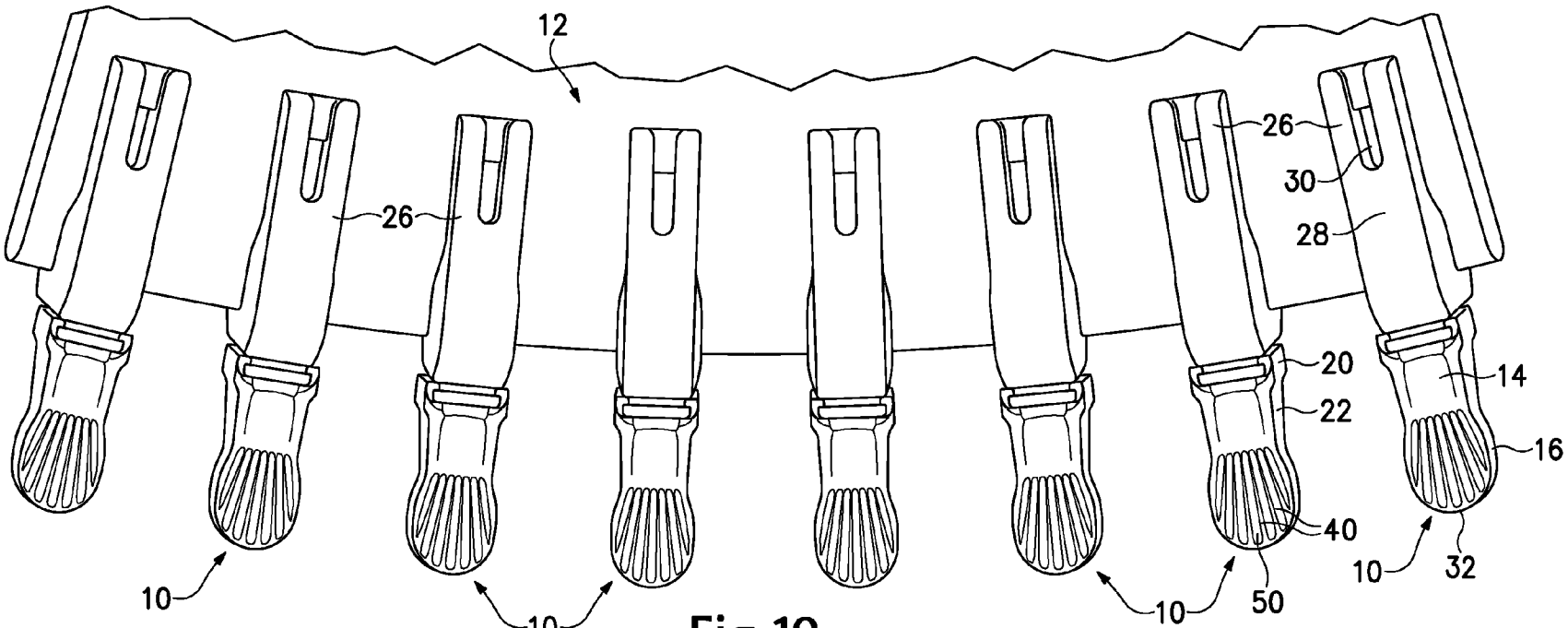
FIG. 10 is a top view of a bucket lip with a plurality of the wear assemblies having wear members in accordance with the present invention attached to it.
Figure 11:
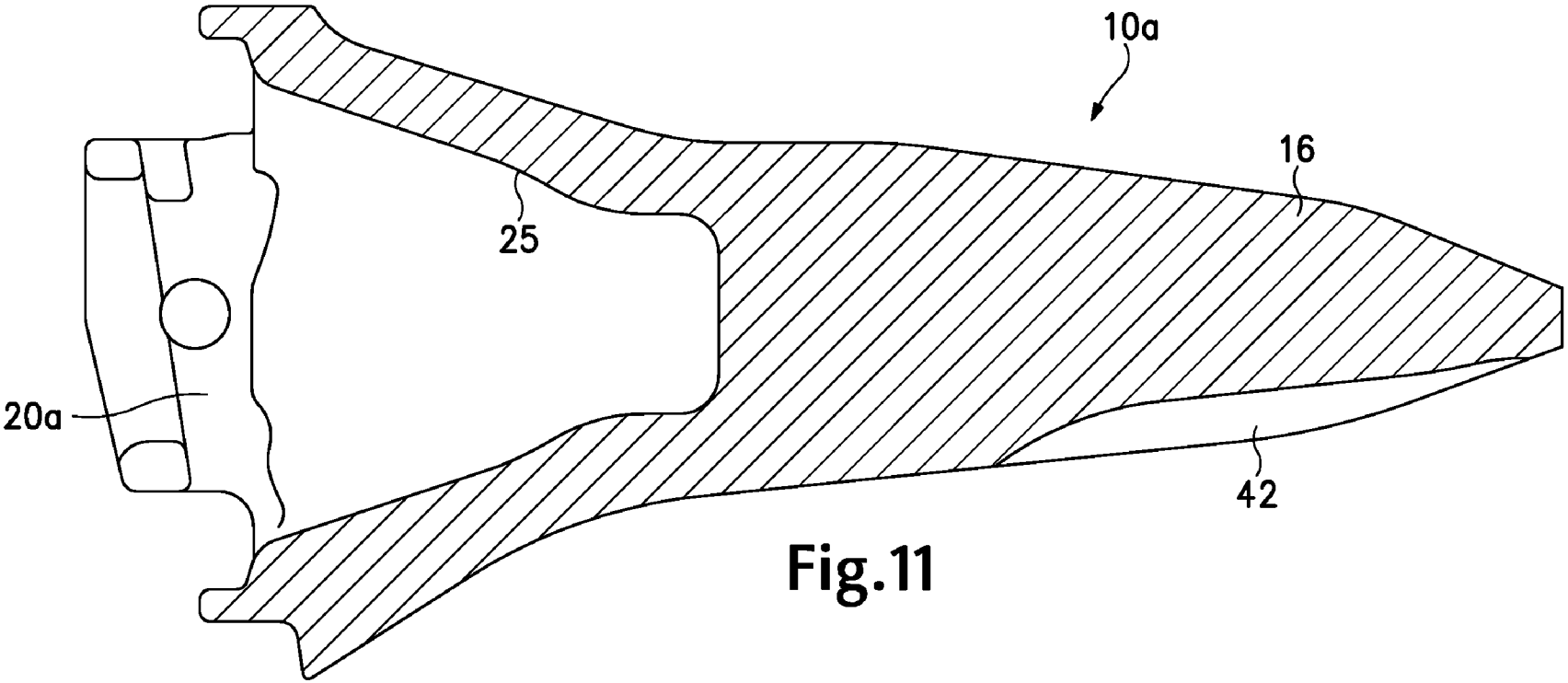
FIG. 11 is a vertical cross sectional view of an alternative wear member in accordance with the present invention.

In one example, as seen in FIG. 10, a series of points 10 are mounted onto the noses of adapters 26 spaced along the front edge of a bucket lip 12. The adapters include legs 28 to straddle lip 12. Each leg 28 includes an opening 30 that aligns with a through-hole in the lip for receiving a Whisler-style lock (not shown) to secure the adapters to the bucket. As the bucket is moved into and through the ground, the free working ends 16 penetrate and break up the ground in advance of lip 12 to enhance the digging operation.

Front working end 16 is a bit defined by top and bottom converging walls or surfaces 34, 36, and sides 38 (FIGS. 1-4). Sides 38 are extensions of sidewalls 22 in mounting portion 14. The converging top and bottom surfaces 34, 36 converge in a forward direction to the front free edge 32, which is adapted to penetrate the ground. Additionally, while converging surfaces 34, 36 are at times in this application referred to as top and bottom surfaces, wear member 10 is reversible and can be used with either surface 34, 36 as the top surface in a digging operation. Nonetheless, the concepts of the invention can be used in conjunction with asymmetrical, non-reversible points as well.

Figure 4:
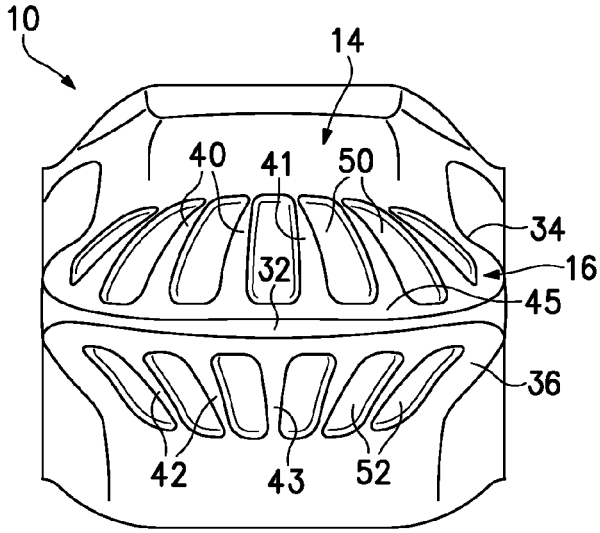
FIG. 4 is a front view of the wear member.
Figure 5:
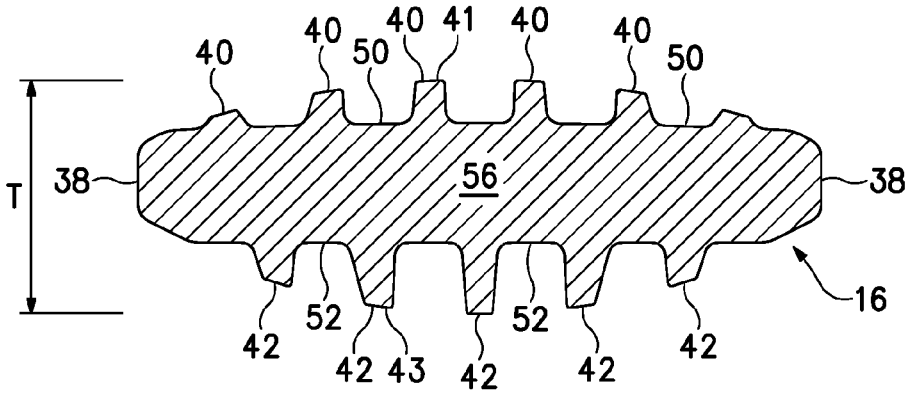
FIG. 5 is a cross-sectional view taken along line 5-5 in FIG. 2.
Figure 6:
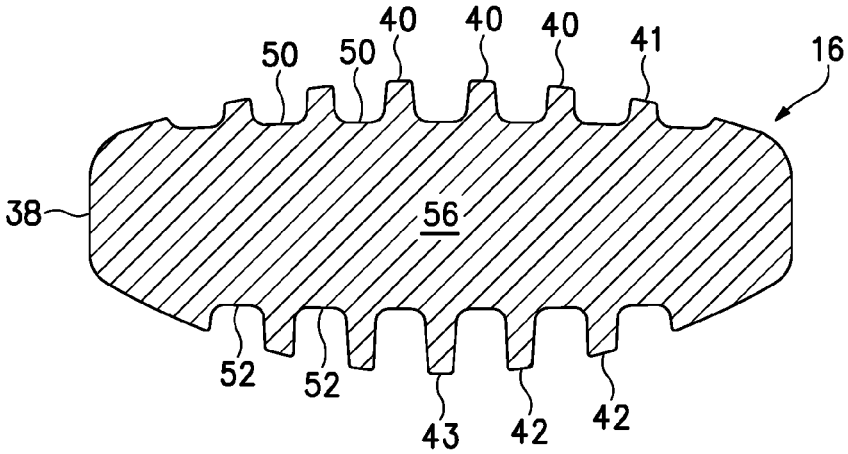
FIG. 6 is a cross-sectional view taken along line 6-6 in FIG. 2.

Ridges 40, 42 are formed along at least one and preferably each of the converging surfaces 34, 36 for strength, stability and ease of penetration into the ground (FIGS. 1-4). The ridges 40, 42 are preferably positioned across the central region 47 of the bit 16 to achieve optimal performance. In a preferred construction, the ridges are linear, extend generally in an axial direction from mounting end 14 to penetrating edge 32, and are splayed to diverge slightly in a forward direction. The ends 40*a*, 40*b*, 42*a*, 42*b* of ridges 40, 42 are preferably integrally formed with the converging surfaces 34, 36 such that the outer faces 41, 43 of the ridges 40, 42 are generally aligned with the exterior wearable surfaces 34, 36. A trough or recess 50, 52 is defined along each side of each ridge, i.e., between each of the adjacent ridges 40, 42, and between the outside ridges and a marginal portion 45 of the bit. As seen in FIGS. 4-6, ridges 40 are preferably laterally offset from ridges 42; i.e., ridges 40 are generally aligned with troughs 52, and ridges 42 are generally aligned with troughs 50. With this arrangement, bit 16 can be stronger and less prone to break. The use of ridges 40, 42 also reduces the overall weight of wear member 10. Nevertheless, the ridges could be aligned or have a different configuration.

It is common in excavating teeth, when points are new, to have top and bottom surfaces that converge toward a front end to define a narrow penetrating edge to minimize the surface area that initiates contact with the ground. By presenting a small contact area, the teeth can more easily penetrate the ground. The easier the ground is penetrated, the more efficient the digging operation. The digging action, however, causes the bits to wear away such that the point becomes shorter with use until it needs to be replaced. Since points have a generally wedge-shaped configuration, the penetrating edge evolves and grows larger as the bit wears away. The enlarged contact area results in more and more power being needed to drive the bucket into and through the ground. As a result of this increased resistance, the point often needs to be replaced before the bit is fully worn away.

Figure 7:
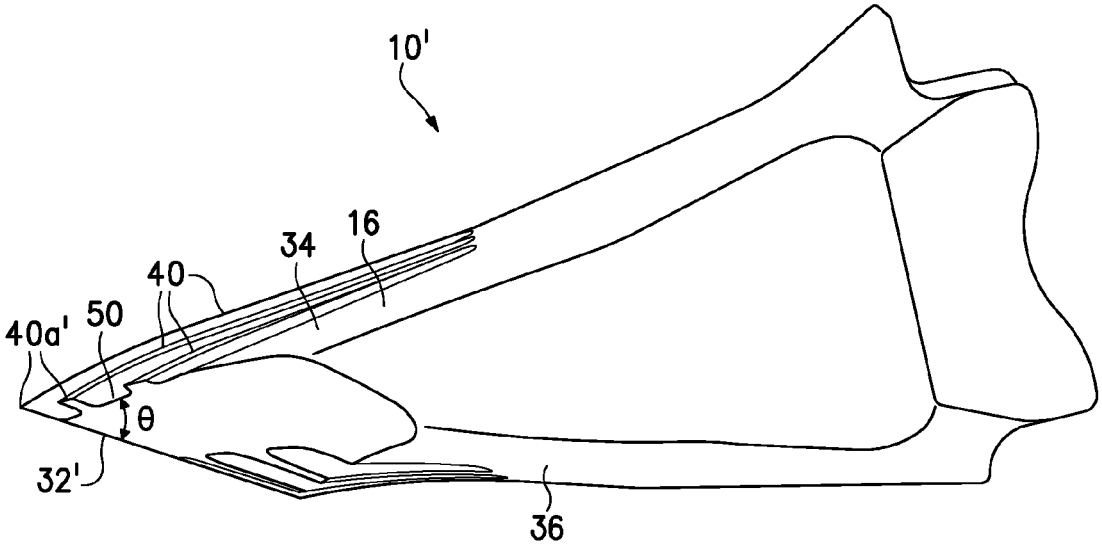
FIG. 7 is a side view of the wear member when partially worn.
Figure 8:
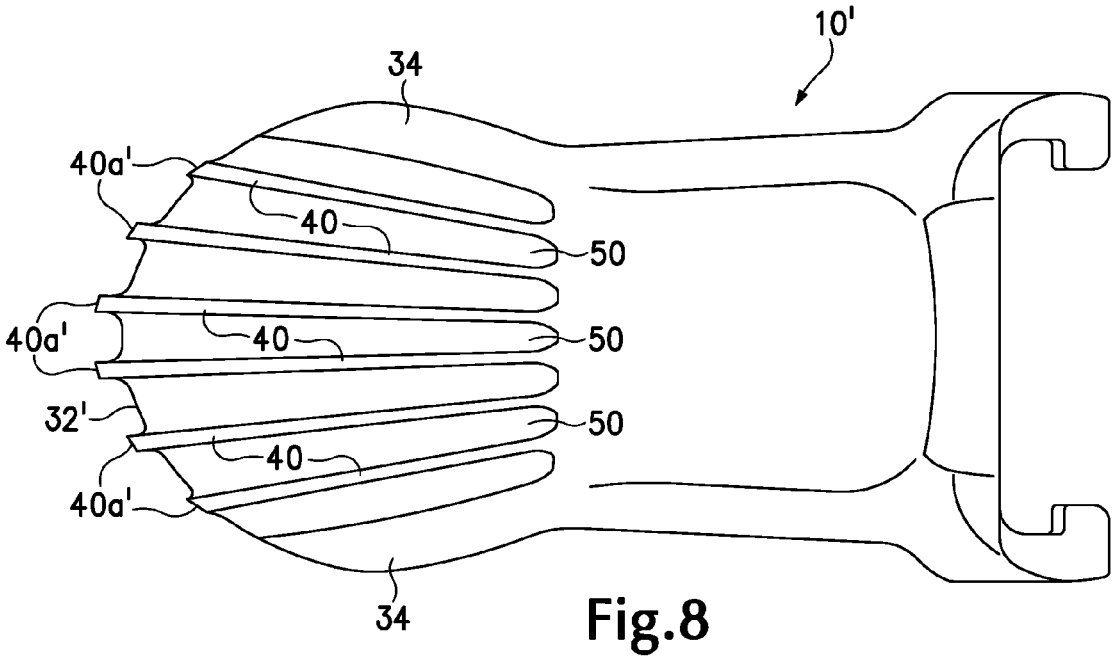
FIG. 8 is a top view of the wear member when partially worn.
Figure 9:
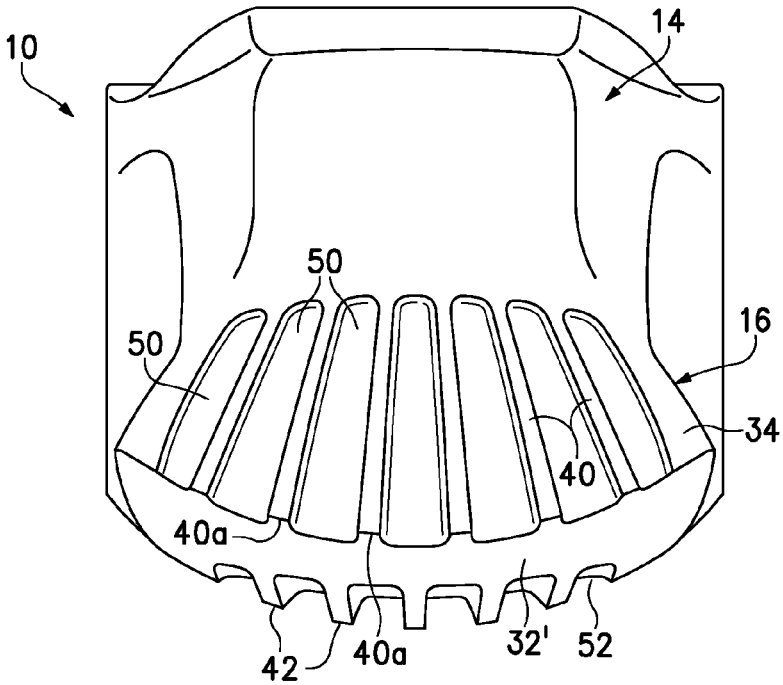
FIG. 9 is a front view of the wear member when partially worn.

In the present invention, the ridges create a serrated penetrating edge 32' as bit 16 wears away, which eases penetration of the worn points. FIGS. 7-9 illustrate a partially worn point 10'. As can be seen, in certain digging operations, the bit normally wears such that penetrating edge 32' is inclined to form an acute angle θ to top surface 34. In other digging operations, the bit may wear such that the penetrating edge is inclined oppositely, i.e., at an acute angle relative to bottom surface 36. On account of this inclination, tips 40*a*' of ridges 40 project forward to define a serrated penetrating edge 32'. Such a serration helps the point cut into and through the ground for enhancement digging efficiency. The forward ends 40*a*' of ridges 40 first engage the ground with a very small contact area making initial penetration easier. The penetrating edge 32' then gradually expands to permit penetration of the entire bit into and through the ground. The ridges may be provided with hardfacing to further enhance the serration. Of course, hardfacing can be provided to additional or other portions of the bit as well.

In addition, as seen in FIGS. 5 and 6, bit 16 includes a body 56 formed as a unitary central mass, and ridges 40, 42 projecting outward from body 56 in generally opposite directions. The combined thicknesses T of body 56 and ridges 40, 42 define a sufficiently thick and robust bit 16 to withstand the rigors and loads of the digging operation. While the illustrated point is particularly adapted for use in low load/high abrasion environments (e.g., oil sand mines), it could be used in other mines and construction sites. Moreover, as necessary, the dimensions of the body and ridges could be adjusted to provide a stronger bit. In any event, the surface area in initial contact with the ground is relatively small, i.e., ridges 40, 42 present only a very small surface area along penetrating edge 32' as opposed to a body forming the whole thickness T. During digging, the earthen material flows around ridges 40, 42 and through troughs 50, 52. Although the overall thickness of the bit increases as it wears away, the use of ridges in the bit enables the penetrating edge to present a relatively small contact area with the ground even as edge 32 approaches mounting end 14. As a result, the digging efficiency is increased as compared to past points without ridges. Also, the point can be used for nearly full length of bit 16.

As seen in FIG. 10, lip 12 is commonly formed with a convex digging edge with the teeth arranged in a bow formation as shown. In a preferred construction, ridges 40, 42 are splayed relative to each other so that the ridges along each converging surface 34, 36 diverge as they extend forward. This arrangement enables ridges in each point 10 to generally lie along the line of motion for the bucket irrespective of which adapter 26 the point is mounted on. This kind of direct positioning of the serrated edge enhances the ability of the points to penetrate into and through the ground. The splayed positioning of ridges 40, 42 also provides the same benefits for use on reverse spade lips, such as disclosed in U.S. Pat. No. 5,084,990 (incorporated herein by reference), and straight lips.

On account of the enhanced ability of point 10 to penetrate the ground, bit 16 can be expanded laterally through a middle region to break up a wider portion of the ground in advance of lip 12 without unduly increasing the digging resistance (FIGS. 1-4). In a preferred construction, bit 16 is wider than the mounting portion receiving the nose. While sides 38 are preferably convex and curved to form gradual changes in the bit's width, other configurations can be used.

While a preferred embodiment has been described and illustrated in this application, numerous alterations can be made while retaining at least some of the benefits of the invention. As examples only, the ridges could be parallel to each other or arranged to converge toward the free end. The ridges could be inclined in generally the same direction to longitudinal axis 44. The ridges could also be curved, angular or have other designs such as U or V-shaped. The ridges could extend generally laterally across bit 16 and still form a serrated penetrating edge in partially worn points. The ridges could also be interconnected with each other; in one example, a single, serpentine ridge element may be defined, which is still referred to as a plurality of ridges. The ridges could also be separated from wearable surface 46 by gaps, or they could be raised above or recessed below the exterior wearable surface 46. The ridges along top and bottom converging surfaces could also be vertically aligned with each other or offset in other ways.

The invention claimed is:

1. A wear member for a lip of a bucket for an excavating machine comprising a rear mounting end to attach to a base on the lip and a front working end to engage the ground during a digging operation, the front working portion including top and bottom surfaces that converge toward a front edge, each of the top and bottom surfaces having a central region, wherein each of the top and bottom surfaces of the front working portion has a plurality of spaced apart ridges and a plurality of troughs between the ridges positioned across the central region that extend generally in an axial direction to form a serrated penetrating edge as the front edge wears during use, wherein the ridges along the top surface laterally diverge from each other in a forward direction toward the front edge, and the ridges along the bottom surface laterally diverge from each other in a forward direction toward the front edge such that one or more of the ridges on each of the top and bottom surfaces generally lie along the line of motion of the lip for wear members mounted axially and splayed on the lip.

2. A wear member in accordance with claim 1 wherein the ridges extend from the rear mounting end to the front edge.

3. A wear member in accordance with claim 1 wherein each said ridge has an outer face that is generally coincident with one of the top or bottom surface.

4. A wear member in accordance with claim 1 wherein the ridges along the top surface are laterally offset from the ridges along the bottom surface.

5. A wear member in accordance with claim 1 which is a point for an excavating tooth.

6. A wear member in accordance with claim 1 wherein the mounting end includes a cavity for receiving a base structure on the excavating equipment, and an opening for receiving a removable lock to hold the wear member to the base structure.

7. A wear member for a lip of a bucket for an excavating machine comprising a rear mounting end to attach to a base on the lip and a front working end to engage the ground during a digging operation, the front working portion including top and bottom surfaces that converge to a front edge, wherein at least one of the top and bottom surfaces of the front working portion has a plurality of spaced apart ridges and a plurality of troughs between the ridges positioned along a central portion of the respective top or bottom surface and extending generally in an axial direction to form a serrated penetrating edge as the front edge wears during use, wherein the ridges laterally diverge from each other as the ridges extend in a forward direction toward the front edge such that one or more of the ridges on the top surface generally lie generally along the line of motion of the lip for wear members mounted axially and splayed on the lip.

8. A wear member in accordance with claim 7 wherein the ridges extend from the rear mounting end to the front edge.

9. A wear member in accordance with claim 7 wherein the top and bottom surfaces extend over the rear mounting end and the front working end to define an exterior wearable surface, and wherein ridges include outer faces that are generally aligned with the respective exterior wearable surface.

10. A wear member in accordance with claim 7 wherein each said ridge has an outer surface that is generally coincident with one of the top or bottom surfaces.

11. A wear member in accordance with claim 7 wherein the mounting end includes a cavity for receiving the base structure on the excavating equipment, and an opening for receiving a removable lock to secure the wear member to the base structure.

12. A wear member in accordance with claim 7 which is a point for an excavating tooth.

13. An excavating tooth system for excavating equipment comprising:

an adapter that is secured to a lip of a bucket of the excavating equipment;

a point including a rear mounting end to attach to the adapter and a front working end to engage the ground during a digging operation, the front working portion including top and bottom surfaces that converge to a front edge, each of the top and bottom surfaces having a central region, wherein each of the top and bottom surfaces has a plurality of spaced apart ridges and a plurality of troughs between the ridges positioned across the central region that extend generally in an axial direction to form a serrated penetrating edge as the front edge wears during use, wherein the ridges along each of the top and bottom surfaces laterally diverge from each other as the ridges extend in a forward direction toward the front edge such that one or more of the ridges on each of the top and bottom surfaces generally lie along the line of motion of the lip for wear members mounted axially and splayed on the lip; and a removable lock for securing the point to the adapter.

14. A wear assembly in accordance with claim 13 wherein the ridges along the top surface are laterally offset from the ridges along the bottom surface.

15. A wear assembly in accordance with claim 13 wherein the ridges extend from the rear mounting end to the front edge.

16. A wear assembly in accordance with claim 13 wherein the top and bottom surfaces extend over the rear mounting end and the front working end to define an exterior wearable surface, and wherein ridges include outer faces that are generally aligned with the respective exterior wearable surface.

* * * * *